US006848955B2

(12) United States Patent
Kojima

(10) Patent No.: US 6,848,955 B2
(45) Date of Patent: Feb. 1, 2005

(54) METHOD FOR PRODUCING MALE TERMINAL FITTINGS AND TERMINAL FITTING

(75) Inventor: Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/730,828

(22) Filed: Dec. 8, 2003

(65) Prior Publication Data

US 2004/0116004 A1 Jun. 17, 2004

(30) Foreign Application Priority Data

Dec. 10, 2002 (JP) ..... 2002-358483

(51) Int. Cl.[7] ..... H01R 13/00
(52) U.S. Cl. ..... 439/886; 29/885
(58) Field of Search ..... 439/885, 886; 29/885

(56) References Cited

U.S. PATENT DOCUMENTS 4,597,625 A 7/1986 Seidler
5,259,111 A * 11/1993 Watanabe ..... 29/885
6,447,324 B1 9/2002 Nimura et al.
2002/0002007 A1 1/2002 Endo et al.

FOREIGN PATENT DOCUMENTS

| | | |
|---|---|---|
| EP | 0 511 557 A1 | 11/1992 |
| EP | 0 627 797 A1 | 12/1994 |
| EP | 1 045 479 A1 | 10/2000 |
| JP | 5-202497 | 8/1993 |
| JP | 2000-348788 | 12/2000 |
| JP | 2000-348845 | 12/2000 |

* cited by examiner

*Primary Examiner*—Phuong Dinh
(74) *Attorney, Agent, or Firm*—Gerald E. Hespos; Anthony J. Casella

(57) ABSTRACT

Male terminal fittings (1) are produced by press-cutting a flat base plate (8) to form original forms (9) of terminal fittings with base ends (5) forming plated surfaces (13) on the outer surfaces of the original forms (9). Only one layer of plating is formed on all the surfaces of the base ends (5) as the plated surface (13). The method then includes press-cutting a leading end of the base plate (8) to form leading ends (4).

13 Claims, 8 Drawing Sheets

METHOD FOR PRODUCING MALE TERMINAL FITTINGS AND TERMINAL FITTING

BACKGROUND OF THE INVENTION

1. Field of the Invention

The invention relates to a male terminal fitting and to a method for producing male terminal fittings.

2. Description of the Related Art

Japanese Unexamined Patent Publication No. H05-202497 discloses a method for plating parts that project from a strip at specified intervals. There are many points to be improved for a method for producing parts projecting from the strip.

A known male terminal fitting is identified by the numeral 100 in FIGS. 13 and 14. The terminal fitting 100 has a leading end 101 and a base end 102. The leading end 101 is configured for connection with a female terminal fitting (not shown), and has plating applied to two opposite surfaces. The base end 102 will be fixed to an unillustrated circuit board, and has all four surfaces plated for the convenience of soldering.

The male terminal fittings 100 are produced by press-cutting and plating a flat base plate 103, as shown in FIG. 10. More particularly, the base plate 103 is plated on opposed surfaces 104, as shown in FIG. 11. Subsequently, a press-cutting step is performed on the base plate 103 to define the original forms 106 of the terminal fillings as shown in FIG. 12. Thus, the press-cut surfaces (see FIG. 12(B)) of the original forms 106 are not plated. As described above, the base ends 102 must have all the surfaces plated for soldering convenience. Thus, as shown in FIGS. 13 and 14, a second plating step is performed to the base ends 102 of the male terminal fillings 100, to form second plated surfaces 105.

Two plated surfaces 104, 105 are formed on the opposite surfaces of the base end 102 of the terminal fitting 100 and there is a possibility that the two plated surfaces 104, 105 may peel off each other. Additionally more time and cost are necessary for the two plating steps are necessary.

The plating applied to the surfaces 104, 105 often is gold. Thus, an area to which plating is applied should be small to minimize the amount of gold that is used. However, the plated surfaces 104, 105 are formed doubly on the two surfaces. Thus, there is a room for improvement.

SUMMARY OF THE INVENTION

The invention relates to a method for producing male terminal fillings, comprising a press-cutting step and a plating step. The press-culling step includes press-cutting a base plate to form original forms of terminal fillings with base ends. The plating step includes forming plated surfaces on the outer surfaces of the original forms of the terminal fillings.

The press-culling step may comprise press-culling the base plate to form original forms of the terminal fittings with both the base ends and leading ends. In such a case, the male terminal fillings can be produced easily in two steps, namely, the press-culling step and the plating step. In contrast, the prior art method required three steps, namely, a first plating step, a press-cutting step and a second plating step.

The plating step is performed to form the plated surfaces after the base ends are formed by the press-cutting step. Thus, only one layer of plating is formed on all the surfaces of the base ends, and the peeling of the plated surfaces of the base ends is avoided. The plating step takes more time than the press-cutting step. However, the plating step is performed only once. Accordingly, the terminal fittings can be produced more easily as compared to the prior art producing method.

The method preferably comprises forming only the base ends during the press-cutting step, without press-cutting the part of the base plate that becomes leading ends without being press-cut. The method then preferably includes a second press-cutting step performed after the plating step to form the leading ends of the original forms of the terminal fittings. Accordingly, the part of the base plate that will become the leading ends remains as a plate during the first press-cutting step. Thus, deformation of the leading ends can be avoided during transportation of the plate member to a site of the plating step after the press-cutting step.

The second press-cutting step preferably includes removing a remainder piece from the leading ends.

The second press-cutting step preferably includes forming couplings for coupling the adjacent original forms at intermediate positions near the leading ends.

The first press-cutting step preferably includes forming the base ends to extend from a strip arranged at an angle to the base ends, and preferably substantially normal thereto.

The invention may further include forming pitch holes in the strip for engaging projections of a press machine and preferably used to feed the strip.

The plating step preferably includes plating all the surfaces of the original forms excluding the strip.

The invention also relates to a terminal fitting with a base end and a leading end to be connected with a mating terminal fitting. The leading end preferably extends from one end of the terminal fitting and comprises plated portions and non-plated portions. The base end portion preferably is plated fully on substantially all sides. Accordingly, the terminal fitting can be produced more easily and provides for good peeling properties.

The base end preferably is formed to be connected to a plate, such as a printed circuit board.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
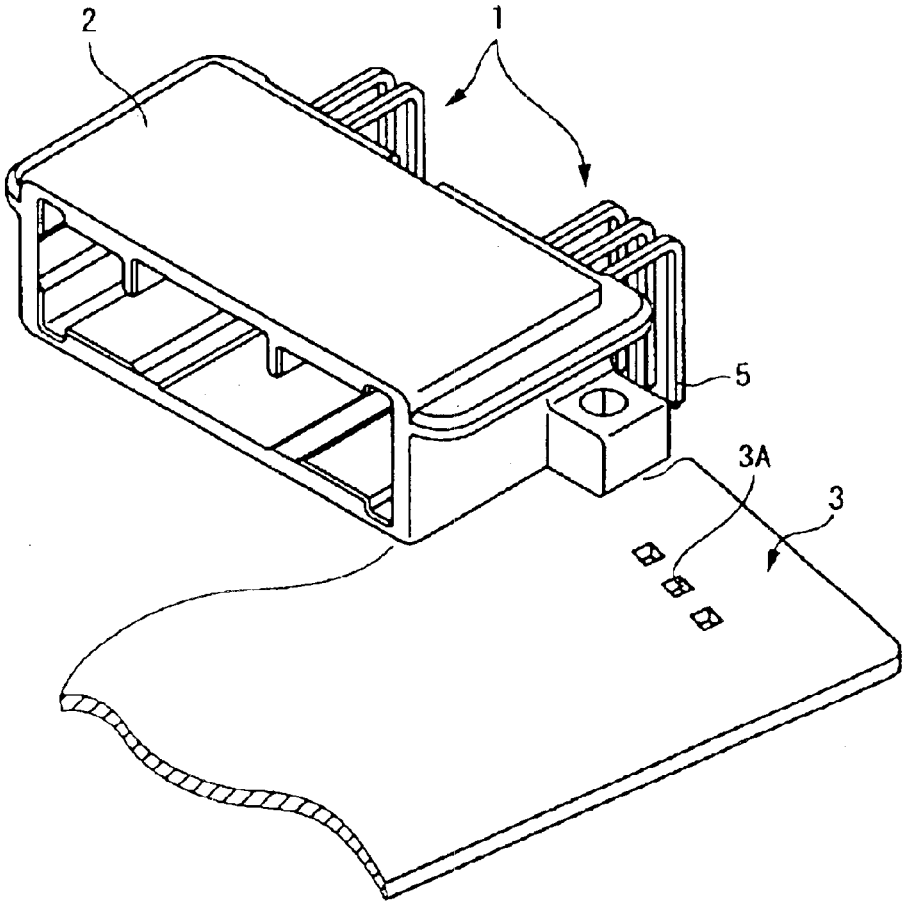
FIG. 1 is a perspective view of a male housing with male terminal fittings produced according to one embodiment of the present invention.
Figure 2:
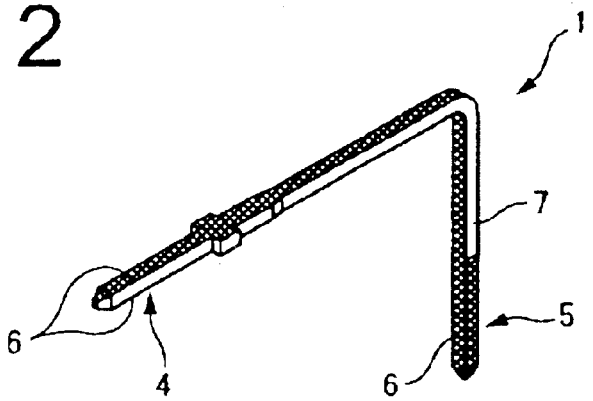
FIG. 2 is a perspective view of the male terminal fitting.

Male terminal fittings produced by the method of the subject invention are identified by the numeral 1 in FIGS. 1 and 2. The male terminal fittings 1 are to be mounted in a male housing 2 that is to be fixed to a plate member, such as a printed circuit board 3. Each male terminal fitting 1 is press-formed of an electrically conductive plate material and is in the form of a substantially rectangular column with a leading end 4 and a base end 5. The leading end 4 is located in the male housing 2 and can be connected with an unillustrated female terminal fitting. A portion of the male terminal fitting 1 rearward of the male housing 2 is bent down at a substantially right angle, as shown in FIG. 1. The base end 5 then is inserted through a fixing hole 3A in the circuit board 3 and is soldered or otherwise connected to a circuit on the circuit board 3.

Figure 3:
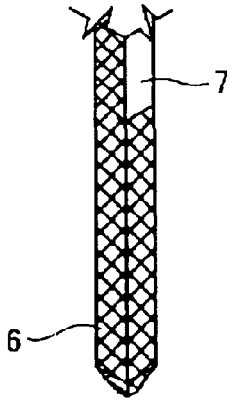
FIG. 3 is a perspective view of a base end of the male terminal fitting.

Plating (e.g. nickel plating, gold plating or the like) is applied at least partly to the leading end 4 and the base end 5 to ensure a good electrical connection. More particularly, the leading end 4 is to have its two opposite surfaces 6 tightly held by the female terminal fitting. Thus, the two opposite surfaces 6 at the leading end 4 should be plated. However, the base end 5 is soldered or otherwise connected to the printed circuit board 3, and plating should be applied to all four surfaces at the base end 5, namely, the two opposite surfaces 6 and opposite cut surfaces 7 (see FIGS. 2 and 3).

Figure 4:
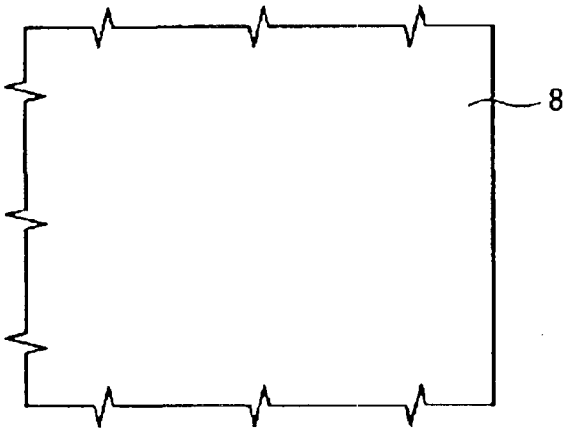
FIG. 4 is a plan view of a base plate used to produce the male terminal fittings.
Figure 5:
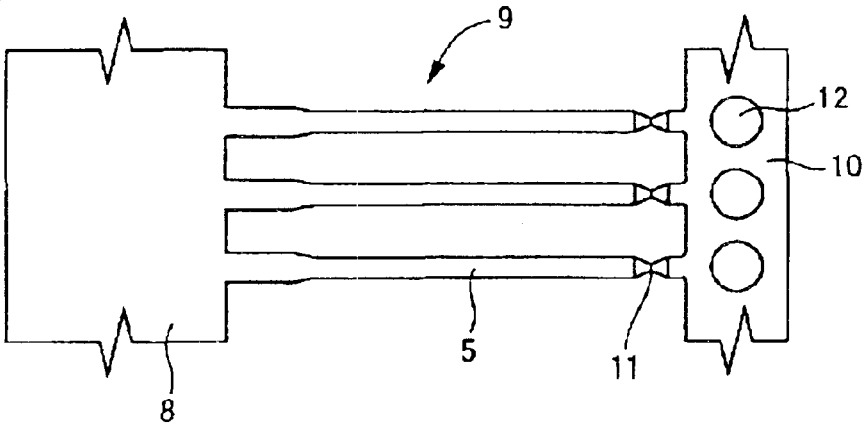
FIG. 5 is a plan view of the base plate after a first press-cutting step.

FIG. 4 shows a small portion of an elongated electrically conductive base plate 8 from which the male terminal fittings 1 are formed. The entire base plate 8 is fed longitudinally through an unillustrated press machine that forms the male terminal fittings 1. More, particularly, the base plate 8 initially is subjected to a press-cutting step to create original forms 9 of the terminal fittings 1, as shown in FIG. 5. The original forms 9 created in the press-cutting step include the base ends 5. However, the base plate 8 remains in its original form at the leading end. The respective base ends 5 extend at substantially right angles from a strip 10. The strip 10 and the base ends 5 are connected by couplings 11 to be cut at the end. Pitch holes 12 in the strip 10 can be engaged with projections (not shown) of the press machine to feed the strip 10 by a specified distance along the longitudinal direction of the strip 10.

The base plate 8 and the original forms 9 attached thereto are transported to a plating factory. During the transportation, the base plate 8 is made smaller by being rolled and the strip 10 is located between layers, such as a CELLOPHANE brand tape. The leading end of the base plate 8 remains in the plate shape without being press-cut, and therefore is not subject to deformation during transportation. In contrast, leading ends 4 that were formed at this stage would narrow, unsupported and physically weak. Such leading ends 4 formed at this stage could be caught by other members and deformed easily.

Figure 6A:
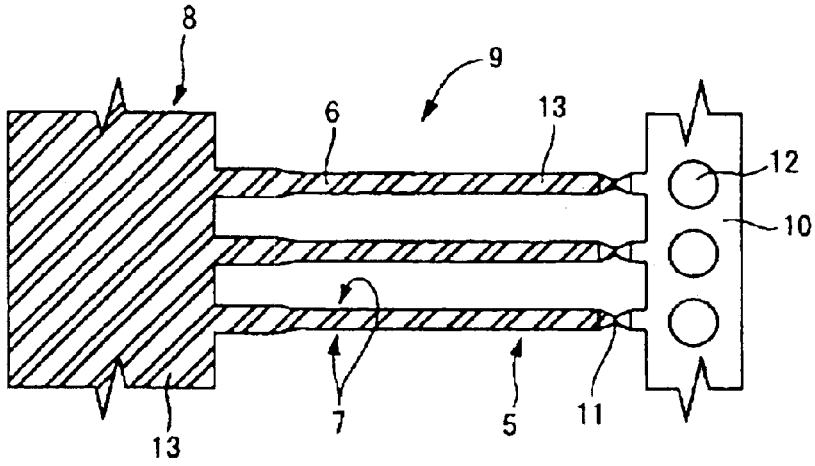
FIGS. 6(A) and 6(B) are a plan view and a side view of the base plate of FIG. 5 after a plating step.
Figure 6B:
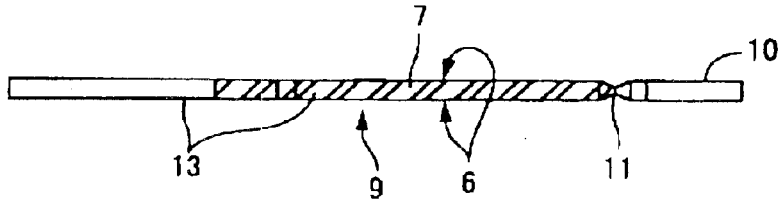

A plating step is performed next to apply plating to the base plate 8 and the original forms 9 to define plated surfaces 13. The plating step may be carried out using either known chemical plating or electroplating processes. In this embodiment, chemical plating is applied while the strip 10 is held above a plating solution. As a result, the plated surfaces 13 are formed on all surfaces, namely the opposite upper and lower surfaces and the cut surfaces created during the press-cutting of the original forms 9, but no plating is applied to the strip 10 as shown in FIG. 6. The plated surface 13 is formed on the two opposite surfaces 6 at the leading end, and is formed on the two opposite surfaces 6 and the opposite cut surfaces 7 press-cut at the base ends 5.

Figure 7:
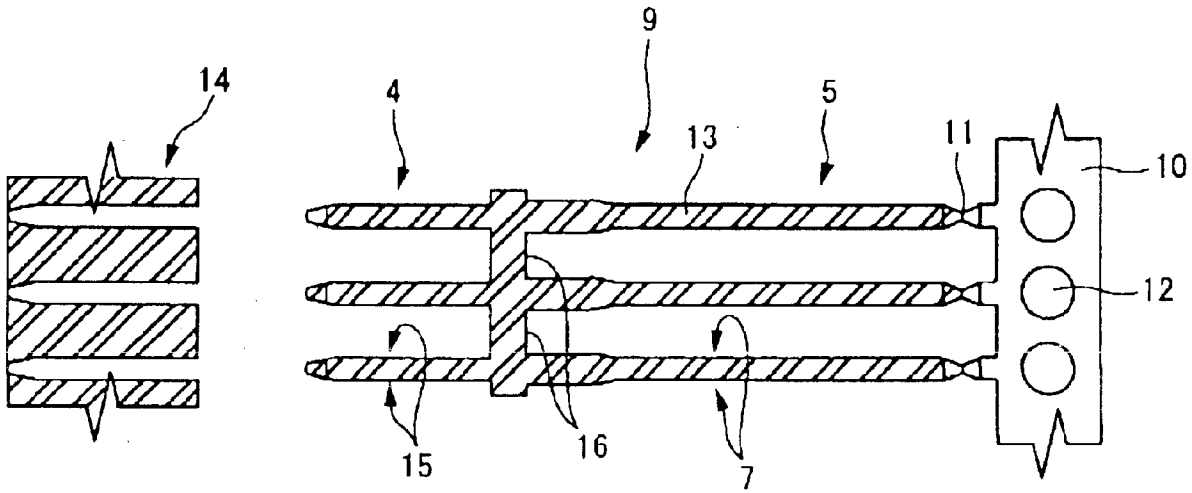
FIG. 7 is a plan view of original forms when a second press-cutting step is performed.
Figure 8:
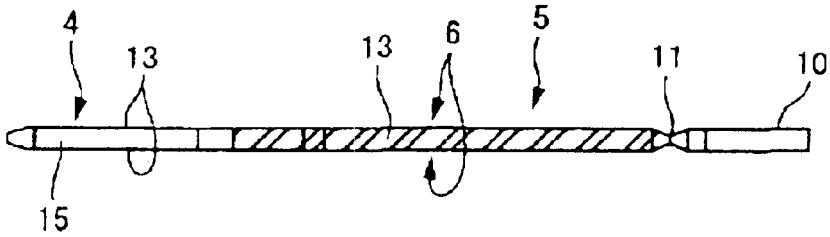
FIG. 8 is a side view of the original forms when the second press-cutting step is performed.
Figure 9A:
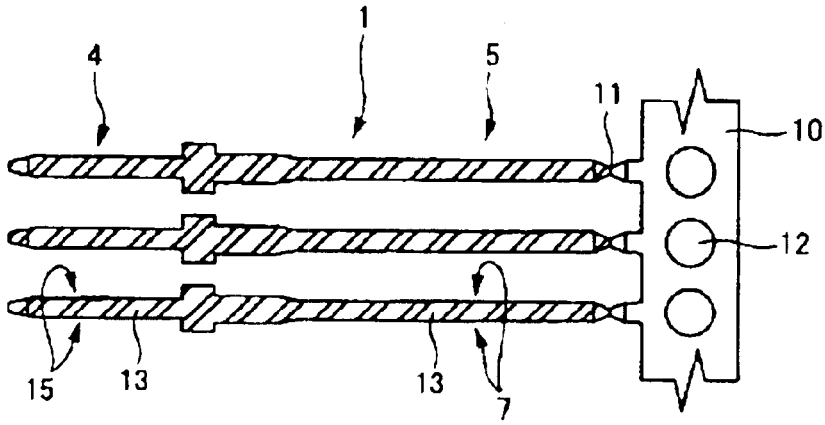
FIGS. 9(A) and 9(B) are a plan view and a side view of the original forms further press-cut.
Figure 9B:
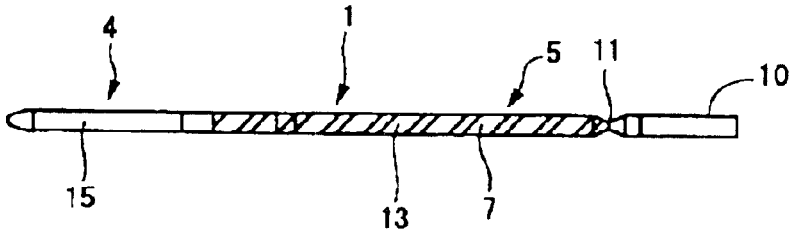
Figure 10:
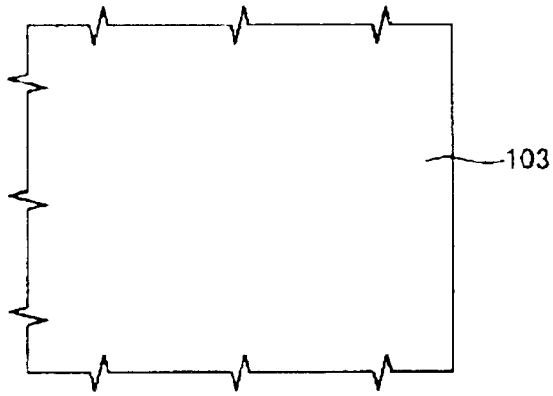
FIG. 10 PRIOR ART
FIG. 10 is a plan view of a base plate used to produce male terminal fittings according to a prior art producing method.
Figure 11:
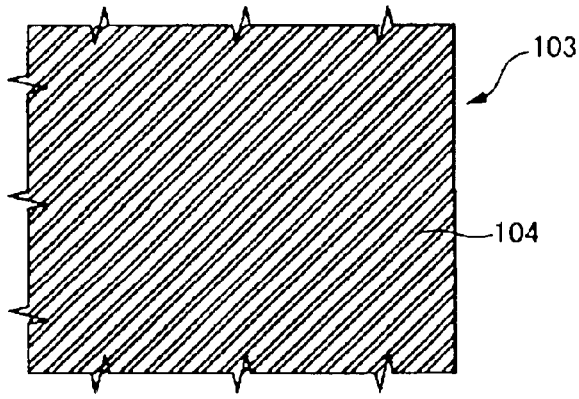
FIG. 11 PRIOR ART
FIG. 11 is a plan view of the base plate after a first plating step according to the prior art producing method.
Figure 12A:
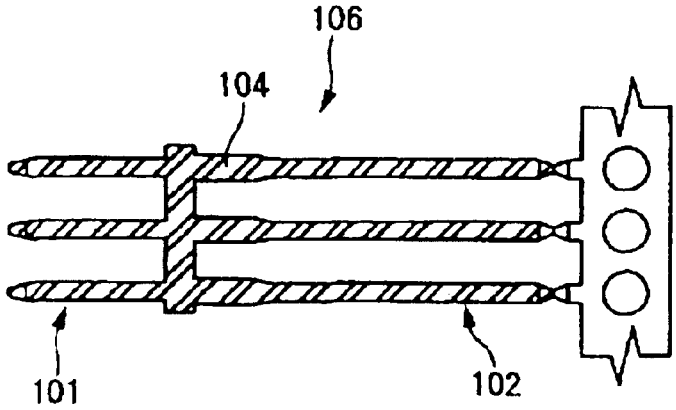
FIG. 12(A) PRIOR ART
FIGS. 12(A) and 12(B) are a plan view and a side view of original forms after being press-cut according to the prior art producing method.
Figure 12B:
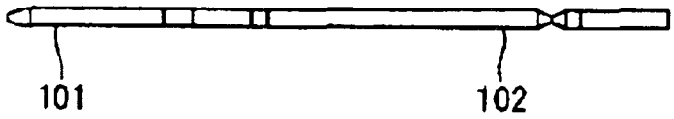
FIG. 12(B) PRIOR ART
Figure 13A:
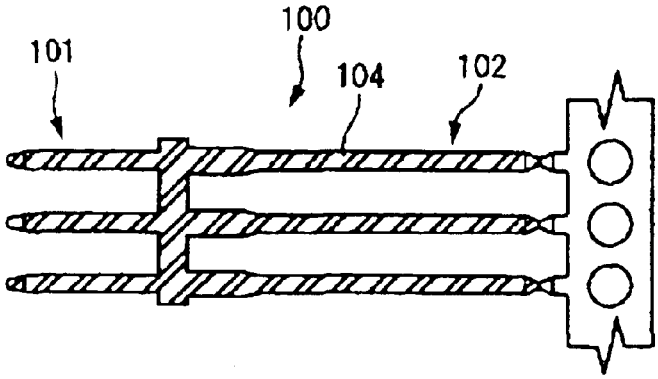
FIG. 13(A) PRIOR ART
FIGS. 13(A) and 13(B) are a plan view and a side view of the original forms after a second plating step according to the prior art producing method.
Figure 13B:
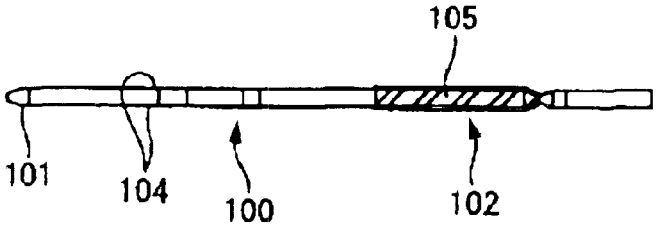
FIG. 13(B) PRIOR ART
Figure 14:
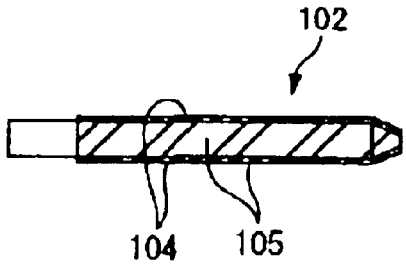
FIG. 14 PRIOR ART
FIG. 14 is an enlarged view of a base end portion of the male terminal produced according to the prior art producing method.

A second press-cutting step then is applied to the plated base plate 8 to form the leading ends 4. The second press-cutting step retains the leading ends 4 with the original forms 9, but removes a remainder piece 14, as shown in FIGS. 7 and 8. The plated surfaces 13 exist only on the two opposite surfaces at the leading ends 4 formed in the second press-cutting step, and second cut surfaces 15 formed by the second press-cutting step are not plated. Adjacent original forms 9 are joined by a coupling 16 at an intermediate position near the leading ends 4.

The coupling 16 is press-cut to separate the respective male terminal fittings 1 from each other after the original forms of the male terminal fittings 1 are formed. Further, the couplings 11 are cut to separate the respective male terminal fittings 1 from the strip 10. The male terminal fittings 1 then are mounted into the male housing 2.

As described above, only a single-layer plated surface 13 is formed on all the surfaces of the base end 5 because the plating is applied to the press-cut base ends 5 to form the plating surfaces 13. Thus, peeling of the plated surfaces 13 of the base end 5 can be avoided. Further, the plating step, which takes more time than the press-cutting step, is performed only once. Thus, the male terminal fittings 1 can be produced more easily as compared to the prior art producing method.

The first press-cutting step forms only the base ends 5, and a part of the base plate 8 that will become the leading ends 4 is left in its original form without being press-cut during the first press-cutting step. The leading ends 4 of the original forms 9 of the terminal fittings are formed by the second press-cutting step after the plating step. Thus, the part of the base plate 8 that will become the leading ends 4 remains as a plate material before the plating step. Therefore, the deformation of the leading ends 4 can be avoided during transportation of the base plate 8 to a site of the plating step.

The plating material often is gold. Thus, it is preferable to make the plated surfaces as small as possible to use a smaller amount of the expensive gold. In this embodiment, all plated surfaces 13 have only one layer of plating. Accordingly, the plated surfaces are small as compared to the prior art where two layers of plating are formed on the base ends 102. In addition, gold may be collected from the plated parts that are not used for the male terminal fittings 1. In contrast, the base plate 103 of the prior art is press-cut after being entirely plated and then the remainder piece is removed. Thus, the remainder pieces are formed at both the base end 102 and the leading end 101 in the prior art. However, in this embodiment, the remainder piece 14 from which gold is to be collected is formed only at the leading end 4. Consequently, an amount of the number of remainder pieces to be collected is reduced, and the collecting operation is facilitated.

What is claimed is:

1. A method for producing male terminal fittings, comprising:

performing a press-cutting step for press-cutting a base plate to define original forms of terminal fittings provided with base ends; and forming plated surfaces on outer surfaces of the original forms of the terminal fittings, wherein only the base ends are formed during the press-cutting step while leaving a part of the base plate to become leading ends without being press-cut.

2. The method of claim 1, wherein the press-cutting step is a first press-cutting step, and wherein the method further comprises performing a second press-cutting step after the plating step to form the leading ends of the original forms of the terminal fittings.

3. The method of claim 2, wherein the second press-cutting step includes removing a remainder piece from the leading ends.

4. The method of claim 3, wherein the second press-cutting step includes forming couplings at intermediate positions near the leading ends.

5. The method of claim 2, wherein the first press-cutting step includes forming the base ends to extend from a strip at substantially right angles.

6. The method of claim 5, wherein pitch holes are formed in the strip for engagement with projections of a press machine to feed the strip.

7. The method of claim 6, wherein the plating step includes forming the plated surfaces on all the surfaces of the original forms excluding the strip.

8. A method for producing male terminal fittings comprising:

providing a base plate with opposite first and second surfaces and opposite first and second edges;

performing a first press-cutting step on the base plate to define a plurality of spaced-apart base ends spaced inwardly from the first and second edges, each base end having two opposite cut edges extending between the first and second surfaces;

plating the base plate to apply plating to the first and second surfaces from the second edge to a location including substantially all of the base ends and for applying the plating to the opposite cut edges of each said base end; and performing a second press-cutting step on the base-plate for forming a plurality of spaced-apart leading ends adjacent the second edge, each of said leading ends having two opposed cut edges extending between the first and second surfaces, such that the cut edges of the leading ends are non-plated.

9. The method of claim 8, wherein the second press-cutting step includes removing a remainder piece from between the leading ends.

10. The method of claim 9, wherein the second press-cutting step includes forming couplings at intermediate positions between the leading ends and the base ends of adjacent terminal fittings.

11. The method of claim 10, wherein the first press-cutting step includes forming the base ends to extend from a strip adjacent the first side edge at substantially right angles.

12. The method of claim 11, wherein the plating step includes leaving the strip substantially unplated.

13. The method of claim 12, further comprising separating the base ends from the strip.

* * * * *